United States Patent [19]

Urayama

[11] Patent Number: 4,529,135

[45] Date of Patent: Jul. 16, 1985

[54] GRINDING CRUSHER

[75] Inventor: Kiyoshi Urayama, Yahata, Japan

[73] Assignee: Kabushiki Kaisha Hosokawa Funtai Kogaku Kenkyusho, Osaka, Japan

[21] Appl. No.: 471,956

[22] Filed: Mar. 3, 1983

[30] Foreign Application Priority Data

Mar. 10, 1982 [JP] Japan ..... 57-37689

[51] Int. Cl.[3] ..... B02C 15/06

[52] U.S. Cl. ..... 241/52; 241/80; 241/115; 241/119; 241/121; 241/159

[58] Field of Search ..... 241/115-122, 241/124, 131, 159, 160, 162, 157, 228, 220, 52, 53, 55, 56, 80, 79.1

[56] References Cited

U.S. PATENT DOCUMENTS

| | | | |
|---|---|---|---|
| 1,736,394 | 11/1929 | Dierker | 241/228 X |
| 1,758,010 | 5/1930 | Pettinos | 241/154 |
| 3,951,347 | 4/1976 | Tiggesbaumker et al. | 241/80 X |
| 4,127,237 | 11/1978 | Mehta et al. | 241/117 X |

FOREIGN PATENT DOCUMENTS

| | | | |
|---|---|---|---|
| 727901 | 10/1942 | Fed. Rep. of Germany | 241/117 |
| 73591 | 11/1953 | Netherlands | 241/117 |

*Primary Examiner*—Mark Rosenbaum
*Attorney, Agent, or Firm*—Edwin E. Greigg

[57] ABSTRACT

There is disclosed a grinding crusher having a grinder piece disposed within a crushing chamber for relative rotation with respect to a casing defining the crushing chamber. The casing is journaled and driven in high speed rotation so as to cause a material within the casing to be centrifugally pressed against the inner peripheral surfaces thereof.

7 Claims, 11 Drawing Figures

GRINDING CRUSHER

BACKGROUND OF THE INVENTION

This invention relates to improvements of grinding crushers of the type each having grinder piece(s) disposed within a crushing chamber for relative rotation with respect to a casing defining the crushing chamber in which a material is ground and crushed.

In a variety of industrial fields, there have in recent years been increasing demands for ultrafine particles of less than 1 micron particle size. However, yields of such ultrafine particles of less than 1 micron particle size as obtained with the conventional mechanical grinding crushers are only around several percent of the total crushed product withdrawn through the crushing treatment, and the productivity has as well been quite poor. Looking in further detail hereinto, as shown in FIG. 6, the conventional grinding crushers are generally constructed in such manner that a casing (4') defining a crushing chamber (3') of the crusher is fixed or slowly rotatable and a driving apparatus (5') rotates grinder piece(s) (9') at relatively high speed along the casing (4') inner peripheral surface. Such being the construction, what comes primarily to mind as the measure for efficient crushing, namely to drive the grinder piece(s) (9') into strong grinding rotation with more high speed relative to the casing (4') with the material to be crushed therebetween, would not work as effectively as intended since the material would then simply move in rotation as entrained with the rotating grinder piece(s) (9') without any sufficient grinding interaction with the casing (4'), thus resulting in a drawback of practically failing to achieve the strong grinding crushing. They also have a further drawback that if the grinder piece(s) (9') is (are) rotated in high speed rotation in the intention of efficient crushing, the consequent swirling air causes to stir up the material to be crushed and thus entrains same in and along the flow, to therefore result in practically lower the grinding crushing efficiency and also in quite lacking uniformity in the product particle sizes.

SUMMARY OF THE INVENTION

In view of the actual status as above, this invention has as its object to provide a simple and rational structure to yield ultrafine particles in excellent efficiency and to realize efficient treatment in large amount, while further realizing the grinding crushing into well-uniform particle sizes.

In order to attain the object, the grinding crusher is according to this invention characterized in that:

the casing is journalled for free rotation, a driving apparatus is provided for driving the casing in high speed rotation about a rotary axis so as to cause the material therewithin to centrifugally be pressed against inner peripheral surfaces thereof, and the grinder piece(s) is(are) disposed either fixed stationary or for gentle absolute speed rotation.

Functional merits accruing from such characteristic construction of this invention are now described in some detail hereunder. Namely, since the material to be crushed is centrifugally firmly pressed against the inner peripheral surfaces and is in such state ground and crushed under the cooperative interaction of the casing and the grinder piece(s), it is possible to effectively restrain the material to be crushed from being retained in little effective movement in rotation relative to the grinder piece(s) without any sufficient grinding interaction with the casing, even the grinder piece(s) is(are) designed so as to provide, between same and the casing, the gradually reducing grinding gap with sufficient eminent gap-reduction ratio in the intention of providing thereby the extremely large grinding force, the restraint being guranteed by properly setting the casing rotation speed to be sufficiently high in good accordance with such eminent gap reduction ratio. Enormous grinding crusher effect, namely the cooperative effect of the enormous centrifugal pressing force and the shearing force, is thus realized and it is hereby made possible to quite effectively obtain even ultrafine particles, for instance with yield of those of less than 1 micron particle size around 30% or 40% in a typical embodiment, thus about ten times as much as in the conventional practice. Furthermore, since the grinder piece(s) is(are) here disposed either fixed stationary of for gentle absolute speed rotation, there occurs no such undesirable phenomenon of the material to be crushed being stirred up by and flown up into the ambient swirling stream accompanying the rotating grinder piece(s), no matter how high is the relative rotational speed between the casing and the grinder piece(s). To the contrary, the higher the relative, thus also absolute, rotation of the casing, accordingly the stronger centrifugal pressing up of the material to be crushed against the casing inner periphery. Consequently, it is now hereby possible to effect enormous grinding crushing force to the material to be crushed in a state compacted to high density, to thus yield quite fine particles very efficiently and realize the grinding crushing treatment in quite excellent treating efficiency on account of the extremely high relative rotation between the material to be crushed and the grinder piece(s). Moreover, since the material to be crushed may be expected to be put in a state as if relatively fixed with respect to the casing, as strongly pressed under enormous centrifugal force against the casing inner periphery, it is now also possible to apply the grinding crushing treatment efficiently uniformly all over the material to be crushed, and therefore to securely yield excellent quality product particles of quite narrow particle size distribution.

In a preferred embodiment of this invention, the crushing chamber is in communication with a material feed passage on one end side in a direction of the rotary axis of the casing and with a crushed product withdrawal passage on the other end side in the direction of the rotary axis. Crushing work in continuous operation is hereby made possible, to thus remarkably enhance the work efficiency.

As further characteristic embodiments, the inner peripheral surfaces of the casing may have their diameters as are either gradually or stepwise discontinuously skippingly the smaller at the position nearer the feed passage and the larger at the position nearer the withdrawal passage. Further excellent and favorable grinding crushing is hereby realized, since the crushed particles in the later stage during the processing, as are therefore the more pulverized and are thus otherwise apt to flow up into the ambient stream, are subjected to the stronger centrifugal force, to thus result in that the entire material is properly pressed against the casing inner periphery by the force quite uniformly distributed all over the said entire periphery.

In a still further preferred embodiment, annular ring(s) is(are) provided to extend inwardly from the inner peripheral surface of the casing, so as to serve as overflow weir(s) partitioning thereby the crushing chamber into the respective sections in the direction of the rotary axis. It is hereby possible to successively forward and advance to the next subsequent section only the particles sufficiently finely pulverized in the respective section, thus to further secure and enhance the quality of the grinding crushing.

Still other modifications and the advantages accruing therefrom will be apparent from the detailed description to follow hereunder.

DETAILED DESCRIPTION OF THE PREFERRED EMBODIMENTS

Figure 1:
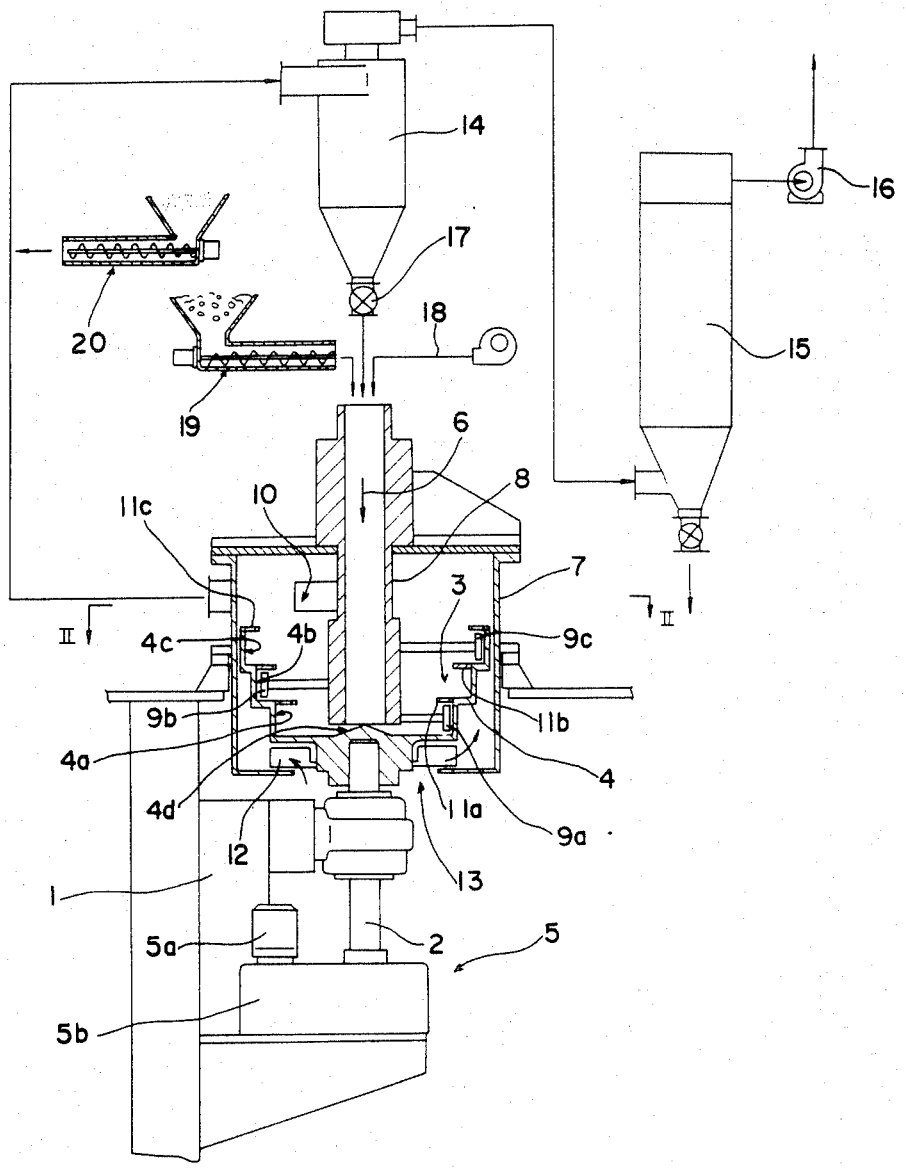
FIG. 1 is a side elevation, partly in vertical section, of an embodiment of the grinding crusher according to this invention, together with diagramatic flow-chart-like illustration of the auxiliary devices included in the entire crushing installation.
Figure 2:
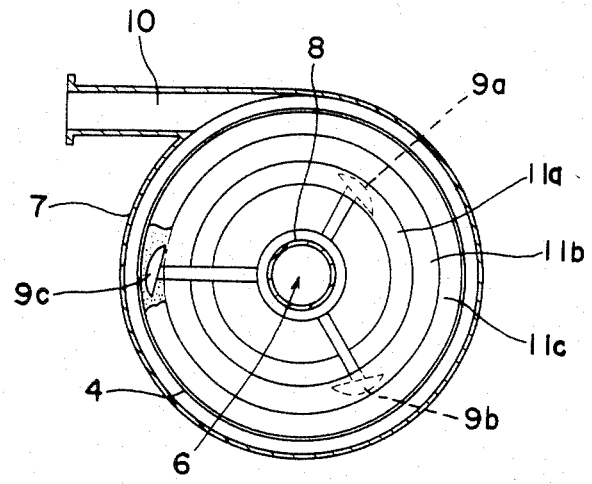
FIG. 2 is a sectional view on a plane shown at II—II in FIG. 1, FIGS. 3(*a*),(*b*) are vertical sectional views of the respective modifications of the crushing chamber casing.

An embodiment of the grinding crusher shown in FIGS. 1 and 2 is first described hereunder:

On a base (1) there is rotatably journaled an upright rotary shaft (2). A crushing chamber (3) is defined by a bottomed tubular casing (4) which is mounted on an upper end of the rotary shaft (2), while a lower end of this latter is operatively connected to a driving apparatus (5) consisting of an electric motor (5*a*), speed changer (5*b*) and so forth. The casing (4) is adapted to thus be driven in rotation and at the same time to receive therein a material to be crushed, which is therefore centrifugally pressed against casing inner peripheral surfaces (4*a*),(4*b*),(4*c*). In order to attain the centrifugal force in proper accordance with the specific characteristics of the material to be crushed as actually used, the driving is made to be capable of adjusting the rotary speed of the casing (4).

Looking in detail into the material feeding, an upwardly pointed conical protrusion (4*d*) is provided on a bottom center portion of the casing (4), and a passage (6) is provided thereabove for feeding therethrough in downward flow, in alignment with the conical top, the material to be crushed. An outer cover or shell (7) supports a pipe (8) defining the passage, accommodate therein the rotary casing (4), and is in turn supported on the base (1). The pipe (8) has robust grinder members or pieces (9*a*),(9*b*),(9*c*) radially outwardly supported to securely be fixed as integral angularly, namely to be disposed within the crushing chamber (3) so as to grind and crush, in cooperation with the rotating casing (4), the material as fed to be crushed. In order to make it possible to continuously effect the grinding crushing, the shell which includes spaced walls (7) is equipped with and in communication with a passage (10) for withdrawing therethrough the crushed particles as are rotatingly discharged over the top of the crushing chamber (3).

The casing (4) is constructed such that the inner peripheral surfaces have their inner diameters as are stepwise discontinuously skippingly the smaller at the lower position thus nearer the feed passage (6) and the larger at the upper position thus nearer the withdrawal passage (10), that the inner peripheral surfaces (4*a*),(4*b*),(4*c*) of the thusly differently sized diameters are properly opposed to the grinder pieces (9*a*),(9*b*),(9*c*), respectively, and that inwardly on the casing inner peripheral surfaces (4*a*),(4*b*),(4*c*) there are provided annular rings (11*a*),(11*b*),(11*c*) to serve as overflow weirs partitioning thereby the crushing chamber (3) into the respective sections serially in the direction of the rotary axis. It is hereby made possible to successively forward and advance to the next subsequent section, overflowing the respective annular ring (11*a*),(11*b*),(11*c*), only the particles sufficiently finely pulverized in the respective section, and to properly press the entire material against the casing inner peripheral surfaces (4*a*),(4*b*),(4*c*) by the force quite uniformly distributed all over the entire circumference of the crushing chamber (3), on account that the crushed particles in the later stage during the processing, as are therefore the more pulverized and are thus otherwise apt to flow up into the ambient stream, are subjected to the stronger centrifugal force because of the accordingly larger rotary diameter as so arranged as mentioned above.

Directly underneath and in continuation to the casing (4) there is provided a fan (12) for suction of ambient air through a suction inlet (13) defined in a bottom portion of the cover (7) and for forcing the suction air to flow to thus outwardly cool thereby the casing (4) and to ultimately to pass through the withdrawal passage (10) as the stream to entrain therein and transfer therewith the crushed particles, thus as the pneumatic conveying medium.

Serially successively interposed in the further extended line of the withdrawal passage (10) are: a cyclone (14) for classification of the particles; a suitable ultrafine-collector (15) as an electrostatic dust collector or the like; and a suction blower (16); in this serial order as illustrated. The particle-classifier cyclone (14) has its coarse-particle-discharge outlet connected via a rotary feeder (17) to the feed passage (6), to thus recirculate the insufficiently crushed particles back again for further grinding and crushing treatment.

Besides, an injection blower passage (18) for feeding suitable amount of air, inert gas(es) and the like, and a feeder (19) for supplying the material to be crushed, are also connected to the feed passage (6), and another feeder (20) may further be connected to the withdrawal passage (10) for feeding there the material to be crushed as has undergone any suitable preliminary crushing by means of some separate process, to thus make up the material-feeding means in any optimum configuration in due accordance with the specific characteristics of the material to be crushed as actually used.

What is supposed as the object as the material to be crushed may differ in any variety of ways, such for instance as various mineral products as calcium carbonate, talc and so forth, as well as still other products.

Figure 3:
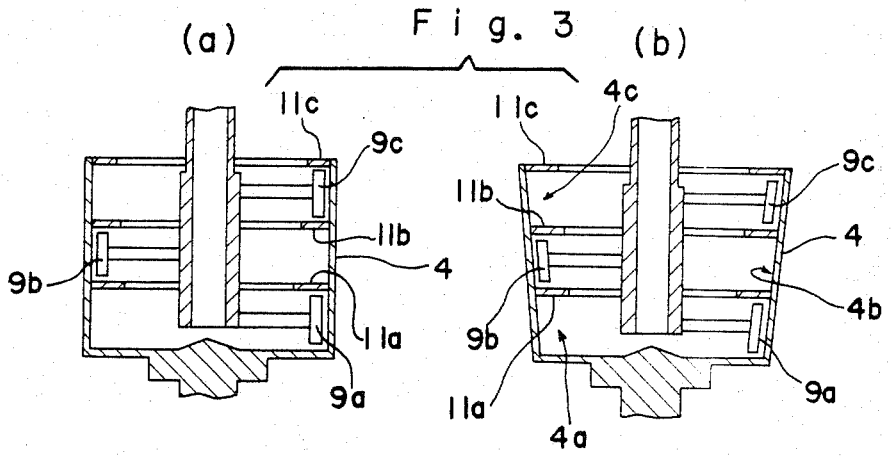
Figure 4:
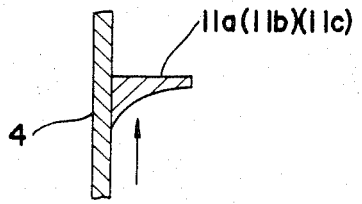
FIG. 4 is a fractional vertical sectional view, in an enlarged scale, of a modification of a crushing-chamber-sectioning annular ring, FIGS. 5(*a*),(*b*),(*c*),(*d*),(*e*) show the respective modifications of grinder pieces, wherein (*a*) and (*b*) are perspective views in an enlarged scale, (*c*) and (*d*) are plan views in an enlarged and non-enlarged scale, respectively, and (*e*) is a vertical sectional view.
Figure 6:
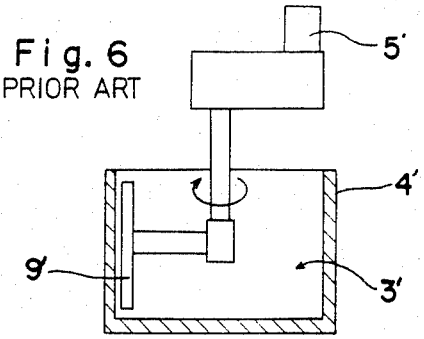
Fig. 6 PRIOR ART
FIG. 6 is a schematic side elevation, partly in vertical section, of a conventional grinding crusher construction.
Figure 5:
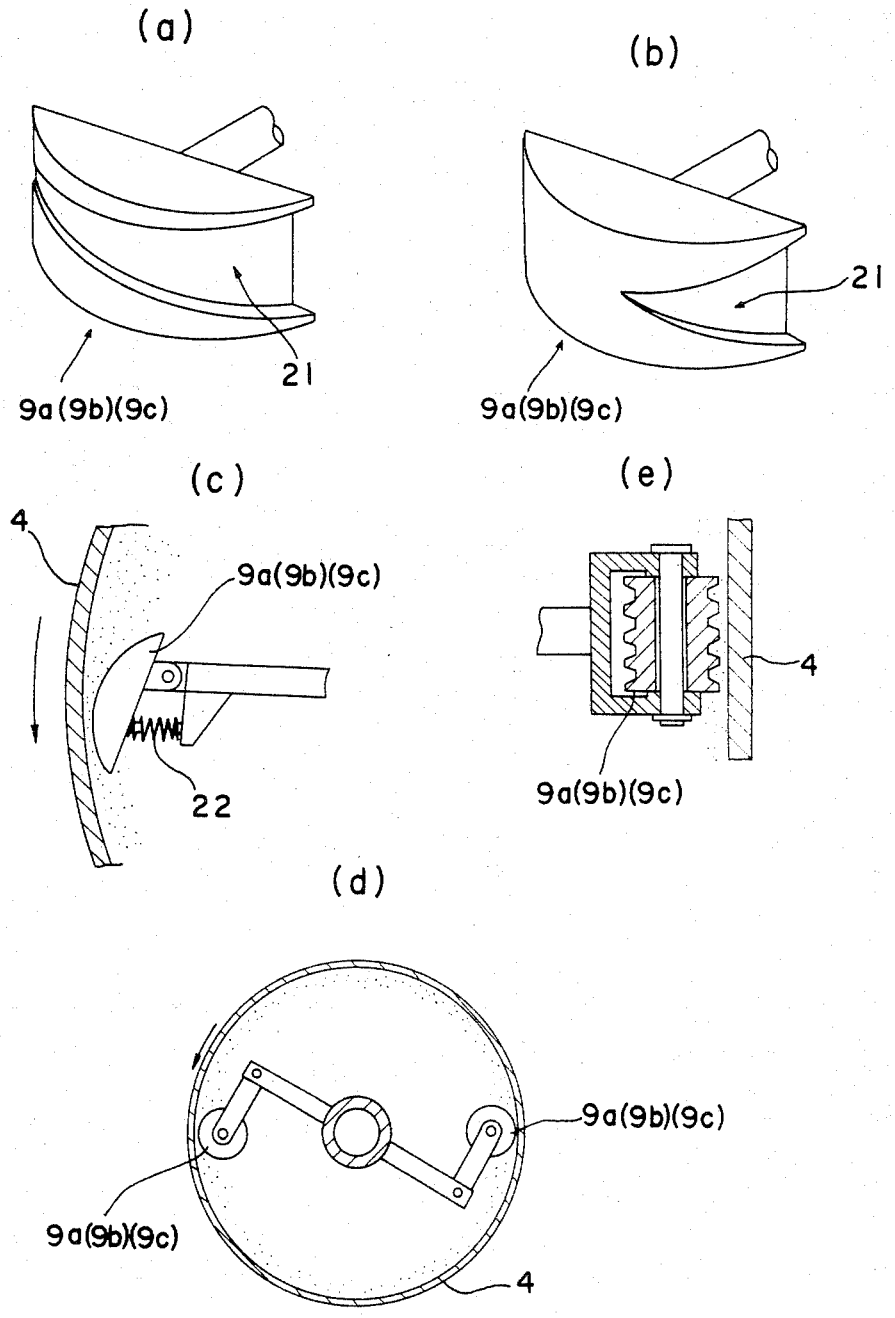

Modifications as shown in FIGS. 3 through 5 are now described hereunder:

Inner peripheral surfaces of the casing (4) may have the shape as is quite freely modified in design, such for instance as generally uniform hollow cylindrical shape as shown in FIG. 3(*a*), or smooth continuous shape as shown in FIG. 3(*b*) with the inner diameter as is gradually the larger at the higher position, or any other shape. Besides, the rotary axis of the casing (4) may as well be slant in any way or extend to lie horizontally, and the rotary speed of the casing (4) may in any proper way be set in good accordance with the conditions as actually given, including the characteristics of the material to be crushed as actually used and the casing inner diameters.

The annular rings (11*a*),(11*b*),(11*c*) may have their cross-sectional shape as shown in FIG. 4, thus having gradually slanting flank or flanks, as will contribute to smoothening the axially advancing movement of the material being crushed. It may as well be free to modify in any way the design of the annular rings (11*a*),(11*b*),(11*c*) in their size, shape, number and so forth. As to the number, it may still as yet sufficiently practical even if such annular rings are entirely omitted.

The grinder pieces (9*a*),(9*b*),(9*c*) may also be modified in quite a variety of ways in their detailed structure. Thus, their working surface to function actively for the grinding crushing may have a depressed groove, two examples of which being shown in FIGS. 5(*a*) and (*b*) at (21), the narrower in width and the shallower in depth at the position the more advanced in the rotational direction of the casing, so as to derive stronger grinding and crushing force from such groove (21). Shown in FIG. 5(*c*) is another possibility where a compression spring (22) urges the grinder piece as is pivoted to be movable against the resilient urging force to escape remote from the casing (4) when some obstacle comes therebetween, so as to thereby avoid dangerous overloading in such occurrence. Similar effect may also be attained by means of using rollers as the grinder pieces, as shown in FIG. 5(*d*). It may further be possible, as shown in FIG. 5(*e*), to provide the roller with annular peripheral grooves of the inwardly narrowing width. Various further modifications are also possible as to the shape, material such for instance as making the outer surface of highly abrasion-resisting material or the like, and the number as well. It is still further possible to provide the grinder pieces (9*a*),(9*b*),(9*c*) as are drivable in gentle speed rotation along the inner peripheral surface of the casing (4) in the direction the same as or reverse to the casing rotation, so as to thereby suitably adjust the relative rotational speed between the grinder pieces (9*a*),(9*b*),(9*c*) and the casing (4). It is yet further possible and preferable to provide the grinder pieces (9*a*),(9*b*),(9*c*) with any suitable cooling jacket to circulate therethrough some proper cooling fluid such as water and the like, thus to forcibly cool down the grinder pieces (9*a*),(9*b*),(9*c*).

As the grinding crusher of this invention as a whole, it may as well be possible to construct same for batchwise operation. Needless to say, auxiliary devices for the grinding crusher, such as those for feeding the material to be crushed into the crushing chamber (3), those for withdrawing the crushed particles, and so forth, may in any proper way be freely modified, added or omitted.

I claim:

1. A grinding crusher mechanism having a vertically disposed axis comprising a tubular shell having an upper extent and provided with an open bottom for entry of a high-speed drive means, a high-speed, controlled, drive means extending through said open bottom, a casing within the tubular shell secured to said drive means and rotatable thereby, said casing forming a crushing chamber and including a bottom and inner peripheral surface walls of different diameter connected by stepped walls axially of said casing, an axially aligned support pipe through which material to be crushed is directed onto said bottom of said casing, said pipe including angularly spaced plural grinder members extending radially therefrom and cooperating with said stepped walls and said inner peripheral surface walls of said casing which cooperate to crush material which is thrown centrifually against said plural grinder members and said inner peripheral walls and classifying means for receiving pulverized material from said tubular shell and for returning unpulverized material to said crusher mechanism.

2. A grinding crusher mechanism as claimed in claim 1, further wherein said plural grinder members are constructed and arranged for gentle absolute speed rotation.

3. A grinding crusher mechanism as claimed in claim 2, further wherein the walls of said casing have diameters that are smaller in proximity to said high speed drive means and larger at the upper extent of said casing.

4. A grinding crusher mechanism as claimed in claim 3 further wherein said walls of said casing have inwardly extending annular rings which are arranged to partition the crushing chamber into respective sections in the direction of the rotary axis.

5. A grinding crusher mechanism as claimed in claim 1, further wherein said plural grinder members are spring loaded in opposition to the direction of rotation of said casing to thereby prevent excessive loading and damaging of the crusher mechanism.

6. A grinding crusher mechanism as claimed in claim 1, further wherein each said grinder member has an outwardly extending surface and each said surface has a portion which includes a variably graduated groove.

7. A grinding crusher mechanism as claimed in claim 6, further wherein said variably graduated groove has a divergent face, said divergent face arranged to extend in the direction of travel of said casing.

* * * * *